US006119429A

United States Patent [19]

Bifano et al.

[11] Patent Number: 6,119,429

[45] Date of Patent: Sep. 19, 2000

[54] CONSTRUCTION SYSTEM AND ACCESSORY

[75] Inventors: Gabriel F. Bifano, Miami; Erenio Reyes, Miramar, both of Fla.

[73] Assignee: Vinyl Corp., Miami, Fla.

[21] Appl. No.: 09/305,631

[22] Filed: May 5, 1999

Related U.S. Application Data

[63] Continuation of application No. 09/059,743, Apr. 14, 1998, Pat. No. 5,946,870.

[51] Int. Cl.[7] ..... E04F 17/00

[52] U.S. Cl. ..... 52/720.1; 52/302.3; 52/443; 52/101

[58] Field of Search ..... 52/302.3, 209, 52/443, 101, 720.1, 734.1

[56] References Cited

U.S. PATENT DOCUMENTS

| | | | |
|---|---|---|---|
| 1,310,331 | 7/1919 | Ficklen . | |
| 2,073,185 | 3/1937 | Shafer . | |
| 2,483,888 | 10/1949 | Danielson . | |
| 2,645,824 | 7/1953 | Titsworth | 52/302.3 |
| 2,703,002 | 3/1955 | Suskind | 52/302.3 |
| 2,905,072 | 9/1959 | Oswald | 52/101 X |
| 3,019,866 | 2/1962 | Grabowski . | |
| 3,239,977 | 3/1966 | Shore | 52/209 X |
| 3,314,201 | 4/1967 | Riegelman . | |
| 3,332,180 | 7/1967 | Price . | |
| 3,471,982 | 10/1969 | Strozewski . | |
| 3,485,001 | 12/1969 | Miller . | |
| 3,494,085 | 2/1970 | Van Bael . | |
| 3,509,674 | 5/1970 | Birum, Jr. . | |
| 3,638,372 | 2/1972 | Rosenthal | 52/209 X |
| 4,059,936 | 11/1977 | Lukens . | |
| 4,075,800 | 2/1978 | Molick | 52/302.3 |
| 4,621,470 | 11/1986 | Balinski | 52/302.3 X |
| 4,622,791 | 11/1986 | Cook et al. . | |
| 4,624,087 | 11/1986 | Schneller . | |
| 4,691,487 | 9/1987 | Kessler . | |
| 4,722,153 | 2/1988 | Hardy . | |
| 4,752,517 | 6/1988 | Beitel . | |
| 4,947,593 | 8/1990 | Kuo | 52/302.3 X |
| 4,984,402 | 1/1991 | Davies . | |
| 5,003,743 | 4/1991 | Bifano et al. . | |
| 5,022,212 | 6/1991 | Lippolt . | |
| 5,226,274 | 7/1993 | Sommerstein . | |
| 5,272,846 | 12/1993 | Kelley et al. . | |
| 5,397,201 | 3/1995 | Novak et al. . | |
| 5,414,965 | 5/1995 | Kelley et al. . | |
| 5,433,986 | 7/1995 | Moscatello . | |
| 5,519,969 | 5/1996 | Golba . | |
| 5,531,050 | 7/1996 | Stibolt et al. . | |
| 5,718,086 | 2/1998 | Dunn | 52/302.3 X |
| 5,729,939 | 3/1998 | Di Benedetto . | |
| 5,784,838 | 7/1998 | Phillips . | |
| 5,836,135 | 11/1998 | Hagan et al. | 52/302.3 X |
| 5,918,427 | 7/1999 | VanderWerf | 52/101 X |

OTHER PUBLICATIONS

"Vinyl Corp. Product Data" Catalog; copyright 1977.
"VinylTech Plastic Components, Inc."; Excerpts from Catalog; 8 pages.

*Primary Examiner*—Beth A. Aubrey
*Assistant Examiner*—Brian E. Glessner
*Attorney, Agent, or Firm*—Foley & Lardner

[57] ABSTRACT

A construction system includes an accessory and a construction panel. The accessory includes a first flange, a second flange and a third flange extending between the first flange and the second flange. The first flange, the second flange and the third flange form a channel. The construction panel is at least partially disposed within the channel. The third flange includes a plurality of perforations extending therethrough. In one embodiment, the plurality of perforations extend in an array. In another embodiment, the accessory additionally includes a fourth flange facing the third flange and spaced from the third flange to form a cavity between the third flange and the fourth flange adjacent to the plurality of perforations.

39 Claims, 2 Drawing Sheets

FIG. 5
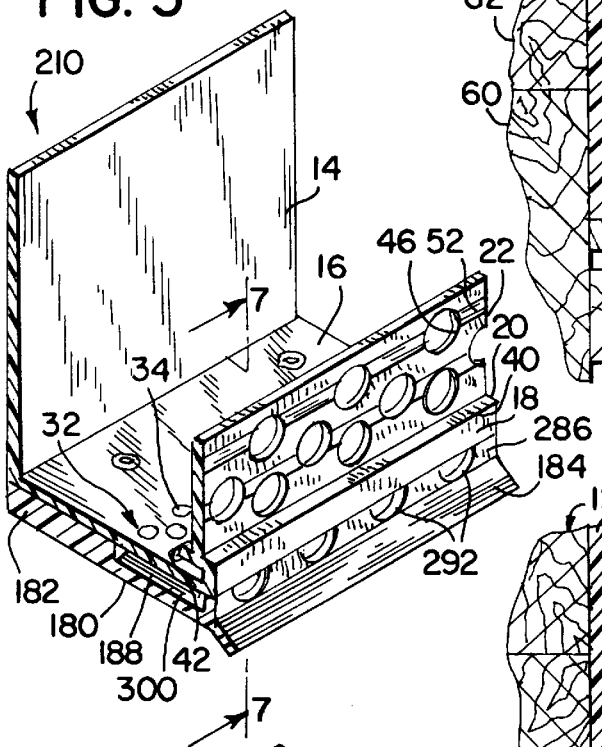
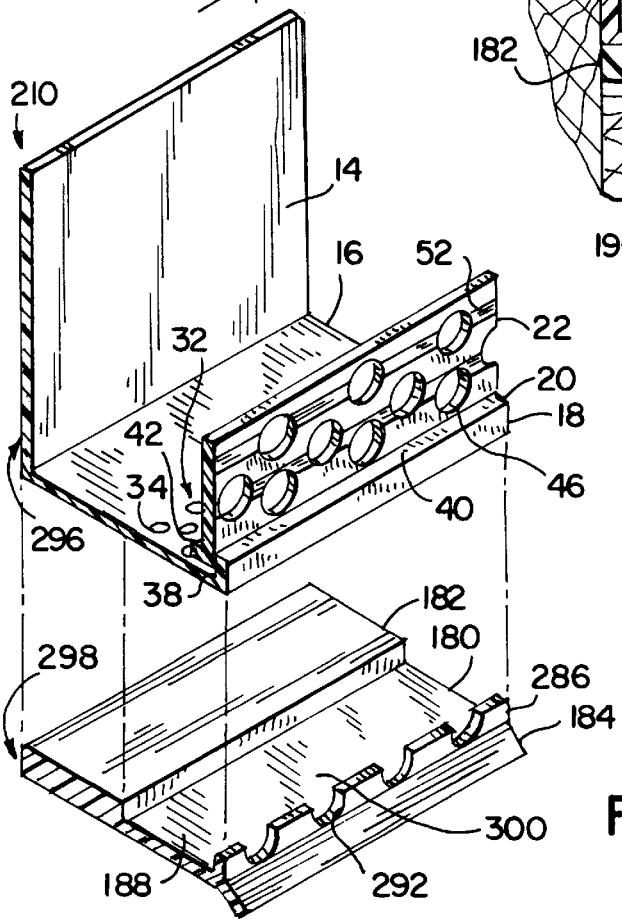
FIG. 6
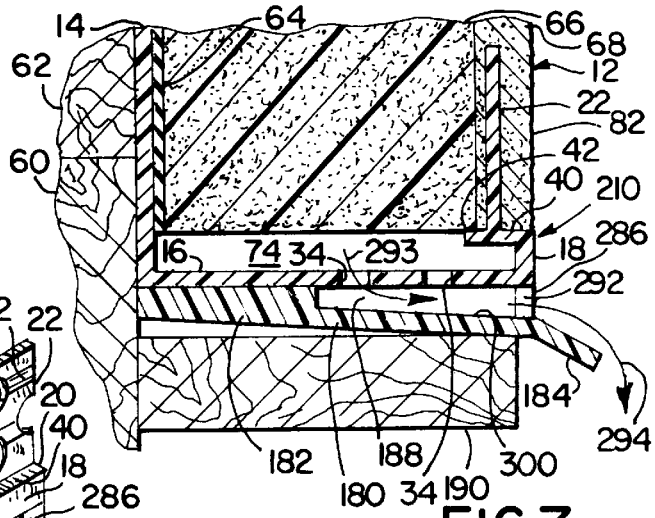
FIG.7
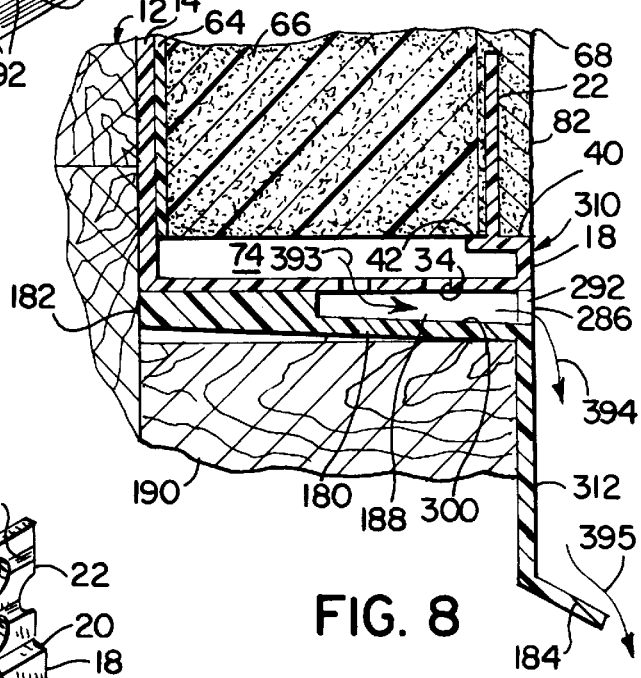
FIG. 8

CONSTRUCTION SYSTEM AND ACCESSORY

RELATED CO-PENDING APPLICATION

The present application is a continuation application of co-pending U.S. patent application Ser. No. 09/059,743 by Gabriel F. Bifano and Erenio Reyes entitled "PANEL SUPPORT CONSTRUCTION ACCESSORY" filed on Apr. 14, 1998, now U.S. Pat. No. 5,946,870. The present application is related to co-pending U.S. patent application Ser. No. 09/059,806 by Gabriel F. Bifano and Erenio Reyes entitled "CONSTRUCTION ACCESSORY" filed on Apr. 14, 1998.

FIELD OF THE INVENTION

The present invention relates to construction accessories. In particular, the present invention relates to a panel support construction accessory utilized in a wall structure, wherein a panel support construction accessory partially encloses a construction panel and removes moisture from about the construction panel.

BACKGROUND OF THE INVENTION

Panel support construction accessories come in a variety of different configurations, shapes and sizes, and serve a variety of different functions in exterior construction applications. Panel support construction accessories generally include a plurality of flanges obliquely extending relative to one another to form a channel sized to receive a construction panel. Panel support construction accessories have various uses, such as supporting panels, supporting coatings of construction fluid materials adjacent the panels, producing durable straight lines, smooth curves and arches, providing soffit ventilation, controlling expansion and contraction and protecting corners and edges. Panel support construction assemblies further protect and preserve edges of construction panels, such as wallboard, sheathing, and insulation boards from impact and condensation. Panel support construction accessories are commonly known by various names, including but not limited to, corner beads, casing beads, starter strip/casing beads, reinforced, drip casing beads, controlled joints and soffit vents. Panel support construction accessories are used in exterior finishing systems known as direct exterior finishing systems (DEFS) and exterior insulated finishing systems (EIFS).

Panel support construction accessories are typically supported adjacent a support structure lined with a moisture barrier. After a construction panel is inserted into the channel of the panel support construction accessory, the front of the accessory as well as the front of the construction panel are typically coated with a polymer based or polymer modified exterior construction fluid material, such as stucco, cement matrix material or gypsum matrix materials, including acrylic modifiers, or are lined with a preformed sheet of weatherproof material. As a result, the panel support construction accessory, moisture barrier and the outer coating, or sheet of weatherproof material, form an enclosure partially surrounding and encasing the construction panel. In addition to encasing the construction panel, the enclosure traps moisture adjacent to the construction panel. Unless perfectly sealed, additional moisture may enter the system through various cracks or openings. Moisture trapped within the enclosure and condenses to damage the construction panel. In addition, trapped moisture may change state from a liquid to a solid (ice) and expand in volume. This change in volume further damages the enclosure by causing the coating to crack or by causing deformation of the panel support construction accessory. As a result, it is critical that moisture within the enclosure be allowed to escape. At the same time, however, it is also critical that any methods used to vent moisture from the enclosure not enable wind-blown moisture to re-enter the enclosure or allow insects, such as flying termites, to enter the enclosure.

SUMMARY OF THE INVENTION

The present invention is directed to the construction accessory which includes a first flange, a second flange and a third flange extending between the first flange and the second flange. The first flange, the second flange and the third flange form a channel. The third flange includes an array of perforations extending through the third flange.

The present invention is also directed to a construction system that includes a construction accessory and a construction panel. The construction accessory includes a first flange, a second flange and a third flange extending between the first flange and the second flange. The first flange, the second flange and the third flange form a channel. The construction panel is at least partially disposed within the channel between the first flange and the second flange. The third flange includes an array of perforations extending through the third flange.

The present invention is also directed to a construction system that includes an accessory and a construction panel. The accessory includes a first flange, a second flange and a third flange extending between the first flange and the second flange. The first flange, the second flange and the third flange form a channel. The construction panel is at least partially disposed within the channel. The third flange includes a plurality of perforations extending therethrough. The accessory further includes a fourth flange facing the third flange and spaced from the third flange to form a cavity between the third flange and the fourth flange adjacent to the plurality of perforations.

BRIEF DESCRIPTION OF THE DRAWINGS

FIG. 5 is a perspective view of a third embodiment of the panel support construction accessory of FIGS. 1 and 2.

FIG. 6 is an exploded perspective view of the panel support construction accessory of FIG. 5.

FIG. 7 is a sectional view of a structure incorporating the panel support construction accessory of FIG. 5.

FIG. 8 is a sectional view of a structure incorporating a fourth embodiment of the panel support construction accessory of FIGS. 1 and 2.

DETAILED DESCRIPTION OF THE PREFERRED EMBODIMENTS

Figure 1:
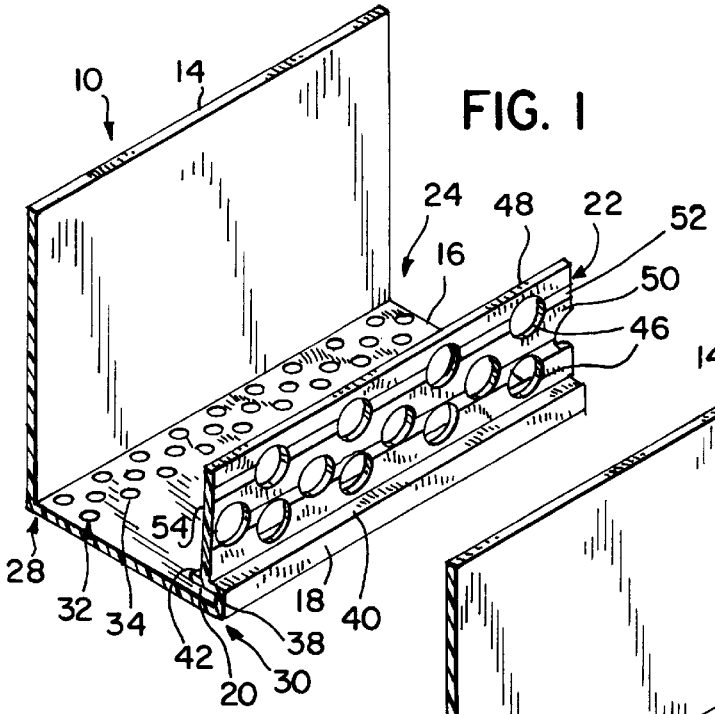
FIG. 1 is a perspective view of an exemplary panel support construction accessory of the present invention.
Figure 2:
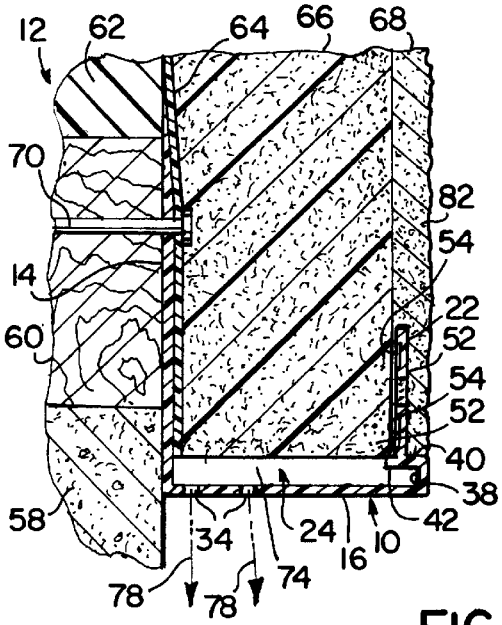
FIG. 2 is a sectional view of a structure incorporating the panel support construction accessory of FIG. 1.

FIGS. 1 and 2 illustrate panel support construction accessory 10. FIG. 1 is a perspective view of panel support construction accessory 10. FIG. 2 is a sectional view of panel support construction accessory 10 utilized in a structure 12. As best shown by FIG. 1, construction accessory 10 generally includes back flange 14, bottom flange 16, side flange 18, support flange 20 and front flange 22. Back flange 14, bottom flange 16, side flange 18, support flange 20, and front flange 22 nonparallel extend relative to one another to form an axially extending channel 24 sized to receive and support a construction panel adjacent structural members. Back flange 14 is a generally elongate panel configured for being mounted adjacent to a structural support member of a structure.

Bottom flange 16 comprises an elongate, panel coupled to back flange 14 and obliquely extending from back flange 14. Bottom flange 16 preferably extends nonparallel from back flange 14 at an angle of about ninety degrees. Bottom flange 16 has a first edge 28 coupled to back flange 14 and a second opposite edge 30 coupled to side flange 18. Bottom flange 16 includes an array 32 of perforations 34 extending through bottom flange 16. Perforations 34 generally comprise apertures or openings extending through bottom flange 16 and sized for transmitting moisture from within channel 24. Perforations 34 are configured into an elongate array 32 axially extending along the length of accessory 10 adjacent back flange 14. Array 32 preferably comprises three rows of perforations 34 such that multiple perforations 34 colinearly extend between edges 28 and 30 of bottom flange 16. It has been discovered that array 32 of perforations 34 effectively eliminates moisture from within channel 24. Because array 32 extends along edge 28 of bottom flange 16 adjacent back flange 14, rain and other wind-blown moisture is less likely to be blown through perforations 34 into channel 24. Because perforations 34 have a maximum diameter of approximately one-eighth of an inch, perforations 34 further prevent wind-blown moisture from entering through perforations 34 and further prevent winged insects, such as winged termites, from entering channel 24 through perforations 34. Moreover, because perforations 34 are arranged in an array 32 having a plurality of perforation rows axially extending along bottom flange 16 and having multiple perforations 34 colinearly extending between edge 28 and edge 30 of bottom flange 16, perforations 34 more effectively transmit moisture out of channel 24. In addition, because bottom flange 16 includes an array 32 of perforations 34, accidental blockage of every perforation 34, such as by painting, is generally eliminated.

Side flange 18, support flange 20 and front flange 22 are described and illustrated in co-pending patent application U.S. patent application Ser. No. 09/059,806, by Gabriel F. Bifano and Erenio Reyes entitled "CONSTRUCTION ACCESSORY" filed on the same date herewith (hereby incorporated by reference). As shown by FIG. 1, side flange 18 and support flange 20 form a channel 38 sized to receive a reinforcement member such as a splice (not shown) for connecting adjacent accessories 10. Support flange 20 further forms shoulder 40 and ridge 42, the functions of which are illustrated in FIG. 2. Front flange 22 obliquely extends from support flange 20 between shoulder 40 and ridge 42. Front flange 22 includes perforations 46 which extend between an inner surface 48 and an outer surface 50 of front flange 22. Front flange 22 further includes depressions 52, 54. Depressions 52, 54 comprise elongate channels formed within outer surface 50 and inner surface 48, respectively, of front flange 22. Depressions 52, 54 extend along the axial length of front flange 22 and communicate between perforations 46 to increase the flow of construction fluid materials along front flange 22.

FIG. 2 illustrates panel support construction accessory 10 incorporated into structure 12. As shown by FIG. 2, structure 12 additionally includes foundation 58, structural support members 60, 62, moisture barrier 64, construction panel 66, coating 68 and fastener 70. Foundation 58 and structural support member 60 and 62 form a conventionally known structural arrangement wherein structural support member 60 comprises a base two-by-four and structural support member 62 comprises a stud two-by-four fastened to member 62. As shown by FIG. 2, accessory 10 is fastened to structural support member 60 by fastener 70. To prevent moisture from entering a building or other enclosure formed by structure 12, moisture barrier 64 is positioned within channel 24 over back flange 14 and adjacent structural support members 60 and 62. As can be appreciated, back flange 14 of accessory 10 may be affixed to either structure support member 60 or 62 by various other adhesives or fasteners. Moreover, back flange 14 may alternatively be affixed on intermediate sheet or panel affixed to structural support members 60 and 62.

Figure 4:
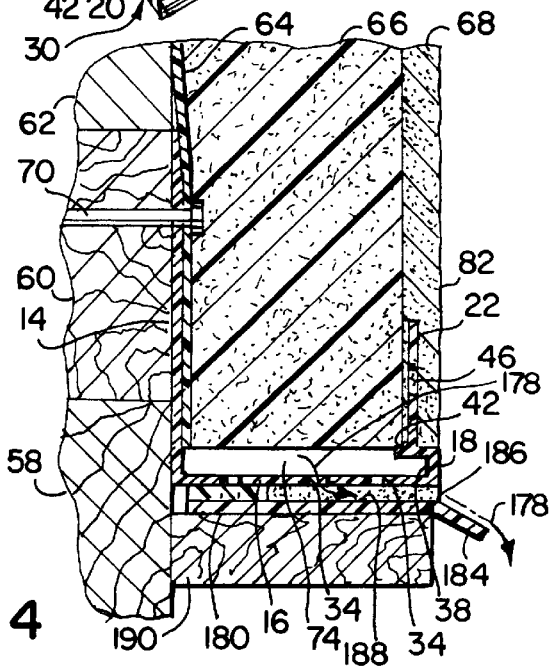
FIG. 4 is sectional view of a structure incorporating the panel support construction accessory of FIG. 3.

Construction panel 66 extends within channel 24 of accessory 10. As shown by FIG. 4, ridge 42 elevates construction panel 66 above bottom flange 16 to form a gap or space 74 between bottom flange 16 and construction panel 66. Space 74 allows moisture accumulation and facilitates the discharge of moisture from between moisture barrier 64 and coating 68 through perforations 34 as indicated by arrows 78.

Shoulder 40 supports coating 68 adjacent front flange 22 and adjacent construction panel 66. As a result, coating 68 forms a frontal surface 82 which is contiguous with a front surface of side flange 18. Consequently, side flange 18 and bottom flange 16 also provide a smooth and impact resistant corner to the front face of structure 12. This corner as well as the front surfaces of side flange 18 and coating 68 may be painted, further finished or left in a natural state.

Construction accessory 10 is preferably extruded from a vinyl compound. Construction accessory 10 is preferably extruded from a weatherable exterior grade polyvinylchloride. Construction accessory 10 alternatively may be formed from various other polymer or vinyl compounds, aluminum, galvanized steel or other metals. Moreover, in lieu of being integrally formed as part of a single unitary body, construction accessory 10 may be formed using various distinct prefabricated components, which are glued, welded or otherwise affixed to one another to form construction accessory 10. Back flange 14, bottom flange 16, side flange 18, support flange 20 and front flange 22 preferably have a thickness of about 1/16th of an inch. As can be appreciated, the thickness of each of flanges 14, 16, 18, 20 and 22 will independently vary depending upon construction application. Perforations 46 preferably have a diameter of about 0.25 inches and are drilled or punched into front flange 22. Depressions 52 and 54 are preferably extruded with front flange 22. Alternatively, perforations 46 as well as depressions 52 and 54 may be formed by various other manufacturing techniques.

Figure 3:
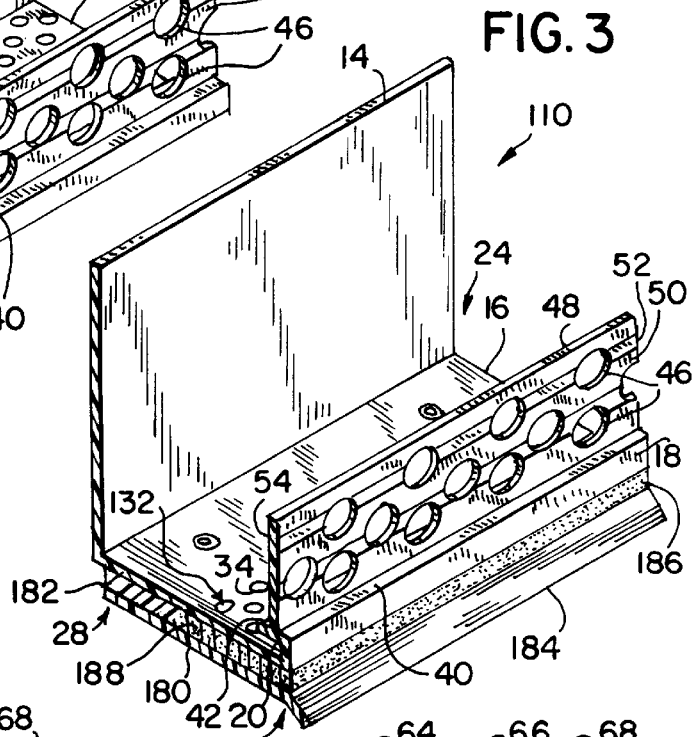
FIG. 3 is a perspective view of a second embodiment of the panel support construction accessory FIGS. 1 and 2.

FIGS. 3 and 4 illustrate panel support construction accessory 110, a second embodiment of panel support construction accessory 10 shown in FIGS. 1 and 2. As shown in FIG. 3, panel support construction accessory 110 includes array 132 of perforations 34 in lieu of array 32 of perforations 34. Accessory 110 additionally includes lower flange 180, spacer 182, drip leg 184 and filter material 186. For ease of illustration, those elements of accessory 110 which substantially correspond to similar elements of accessory 10 are numbered similarly. Array 132 is similar to array 32 except that array 132 extends proximate to edge 30 of bottom flange 16 axially along accessory 110. In particular, array 132 of perforations 34 is transversely located between ridge 42 and spacer 182. As with array 32, array 132 of perforations 34 comprises three rows of perforations 34 such that multiple perforations 34 colinearly extend between edges 28 and 30 of bottom flange 16. It has been discovered that array 32 of perforations 34 effectively eliminates moisture from within channel 24. Because perforations 34 have a maximum diameter of approximately one-eighth of an inch, perforations 34 further prevent wind-blown moisture from entering through perforations 34 and further prevent winged insects, such as winged termites, from entering channel 24 through perforations 34. Moreover, because perforations 34 are arranged in an array 32 having a plurality of perforation rows axially extending along bottom flange 16 having multiple perforations 34 colinearly extending between edge 28 and edge 30 of bottom flange 16, perforations 34 more effectively transmit moisture out of channel 24.

Lower flange 180 is a generally elongate imperforate panel coupled to bottom flange 16 and spaced from bottom flange 16 to form a cavity 188 adjacent to and below array 132 of perforations 34. In the preferred embodiment illustrated, lower flange 180 is spaced from bottom flange 16 by approximately 1/32 to 1/4 of an inch. In the embodiment illustrated, lower flange 180 is spaced from bottom flange by 1/16 of an inch. Lower flange 180 prevents wind-blown moisture from entering channel 24 through perforations 34. Lower flange 180 also impedes flying insects from entering channel 24 through apertures 34. At the same time, lower flange 180 directs moisture expelled from channel 24 through perforations 34 outward towards leg 184. Lower flange 180 is preferably coupled to bottom flange 16 by spacer 182. Alternatively, lower flange 180 may be integrally formed with bottom flange 16 or back flange 14.

Spacer 182 comprises an elongate strip and is positioned between bottom flange 16 and lower flange 180. Spacer 182 preferably has a thickness of about 40–70 thousands of an inch so as to space bottom flange 16 from lower flange 180 by at least a corresponding distance. Spacer 182 preferably has a width transversely extending from edge 28 towards edge 30 of bottom flange 16 such that spacer 182 terminates adjacent to perforations 34. Spacer 182 extends along the axial length of accessory 110 adjacent edge 28 of bottom flange 16. Spacer 182 preferably comprises an independent component fastened, preferably by welding, to both bottom flange 16 and lower flange 180. Alternatively, spacer 182 may be integrally formed as part of a single unitary body with either bottom flange 16 or lower flange 180. It has been discovered that because spacer 182 comprises a component distinct either from bottom flange 16 or lower flange 180, spacer 182 increases the rigidity and stiffness of bottom flange 16. Although less desirable, spacer 182 may alternatively be integrally formed with both flange 16 and lower flange 180.

Drip leg 184 comprises an elongate imperforate strip coupled to bottom flange 16 proximate to edge 30 of bottom flange 16. In the embodiment illustrated, drip leg 184 is coupled bottom flange 16 via lower flange 180 and spacer 182. Alternatively, drip leg 184 may be directly attached to or extruded with bottom flange 16. Drip leg 184 extends away from and beyond edge 30 of bottom flange 16 to direct moisture such as rain or snow away from an underlying structure such as a door or window casing. Because drip leg 184 preferably extends from lower flange 180 below perforations 34, leg 184 additionally directs moisture escaping from space 74 away from the underlying structure. Drip leg 184 obliquely extends from lower flange 180 at a downward angle.

Filter material 186 extends adjacent and over array 132 of perforations 34. Filter material 186 is preferably located within cavity 188 between bottom flange 16 and lower flange 180. Filter material 186 permits the flow of moisture through filter material 186. At the same time, filter material 186 prevents larger aggregations of wind-blown moisture as well as flying insects from passing through filter 186 and through perforations 34. Although filter material 186 may comprise any one of a variety of known materials having such characteristics, filter material 186 preferably comprises an open celled vinyl coated mesh or screening. Because filter material 186 preferably comprises an open celled material or screening, filter material 186 further strengthens and rigidifies panel support construction accessory 110.

Construction accessory 110 is preferably extruded from a virgin vinyl compound. Accessory 110 is preferably extruded from a weatherable grade, lead-free polyvinylchloride. Construction accessory 110 alternatively may be formed from various other polymer or vinyl compounds, aluminum, galvanized steel or other metals. Moreover, in lieu of back flange 14, bottom flange 16, side flange 18, support flange 20 and front flange 22 being integrally formed as part of a single unitary body, components may alternately be formed using various distinct prefabricated components which are glued, welded or otherwise affixed to one another to form construction accessory 110.

As shown by FIG. 4, moisture accumulates within space 74 below construction panel 66 and above bottom flange 16. As shown by arrows 178, moisture accumulated within space 74 flows through perforations 34 and through filter material 186 between bottom flange 16 and lower flange 180. The moisture further flows across lower flange 180 and is directed away from window or door casing 190 by drip leg 184. As a result, construction accessory 110 facilitates the removal of undesirable moisture otherwise captured between moisture barrier 64 and coating 68 to prolong the life of structure 12.

FIGS. 5–7 illustrate construction accessory 210, a third embodiment of panel support construction accessory 10 shown in FIGS. 1 and 2. FIG. 5 is an assembled view of construction accessory 210. FIG. 6 is an exploded view of construction accessory 210. FIG. 7 is a sectional view of construction accessory 210 utilized in structure 12 including casing 190. As best shown by FIG. 5, construction accessory 210 is similar to construction accessory 110 except that construction accessory 210 includes forward flange 286 in lieu of filter material 186. Alternatively, construction accessory 210 may include forward flange 286 in addition to filter material 186. For ease of illustration, the remaining elements of construction accessory 210 which correspond to similar elements of construction accessory 110 are numbered similarly. Forward flange 286 extends between lower flange 180 and bottom flange 16 adjacent to cavity 188. Forward flange 286 extends opposite spacer 182 to enclose cavity 188. Forward flange 286 preferably includes a plurality of openings 292 that extend through forward flange 286 and communicate with cavity 188.

As best shown by FIG. 7, moisture accumulated within space 74 flows through perforations 34 into cavity 188 as indicated by arrow 293. Moisture within cavity 188 further flows across lower flange 180 through openings 292 where the moisture is directed away from window or door casing 190 by drip leg 184 as indicated by arrow 294. As a result, construction accessory 210 facilitates the removal of undesirable moisture otherwise captured between moisture barrier 64 and coating 68 to prolong the life of structure 12. At the same time, forward flange 286 further impedes wind-blown moisture and flying insects from entering space 74. Because openings 292 extend generally perpendicular to perforations 34, openings 292 and perforations 34 enable moisture to escape from space 74 while reducing, if not completely eliminating, the possibility of wind-blown moisture entering space 74. Although less desirable, openings 292 may alternatively extend through portions of lower flange 180 in lieu of or in addition to extending through forward flange 286 to communicate with cavity 188 depending upon the configuration of construction accessory 210 as well as the configuration of structure 12 and casing 190.

As further shown by FIG. 7, forward flange 286 preferably has a vertical height greater than the vertical height or thickness of spacer 182 such that surface 300 of lower flange 180, which extends adjacent to cavity 188 below perforations 34, downwardly slopes away from back flange 14 and bottom flange 16 towards forward flange 286. In the embodiment illustrated, spacer 182 has a height or thickness extending between lower flange 180 and bottom flange 16 of about 0.050 inches while forward flange 286 has a vertical height of about 0.075 inches. In the embodiment illustrated, forward flange 180 is manufactured such that surface 300 has a natural gradient. Alternatively, lower flange 180 may be formed from a deformable or flexible material such that the greater height of forward flange 286 as compared to the vertical height of spacer 182 causes surface 300 to deform or deflect sufficiently to cause surface 300 to have a downward slope. As shown by FIG. 7, the downwardly sloping surface 300 further facilities the flow of moisture through openings 292 and away from structure 12.

FIG. 6 best illustrates the preferred assembly of construction assembly of 210. As best shown by FIG. 6, construction accessory 210 is preferably constructed from a first panel support component 296 and a second add-on component 298. Component 296 includes back flange 14, bottom flange 16, side flange 18, support flange 20 and front flange 22. Component 298 includes lower flange 180, spacer 182, drip leg 184 and forward flange 286. Lower flange 180 of component 298 is configured for being coupled to component 296 so as to extend below bottom flange 16 and so as to provide surface 300 spaced from bottom flange 16 below perforations 34. In the embodiment illustrated, spacer 182 couples lower flange 180 to bottom flange 16 of component 296.

As shown by FIG. 5, components 296 and 298 are preferably coupled together by welding. In particular, spacer 182 of component 298 is positioned adjacent to the lower surface of bottom flange 16. Sufficiently heated pins are positioned adjacent a top surface of bottom flange 16 and are further downwardly actuated to pierce bottom flange 16 and partially extend into spacer 182. At the same time, the heated pins melt and fuse the materials of bottom flange 16 and spacer 182 together to securely couple component 296 to component 298. As can be appreciated, other fasteners or fastening methods using glue, adhesives, rivets, thermoplastics, thermosets, epoxies, mechanical interlocks and mechanical fasteners may be used to secure components 296 and 298 together. Of course, these alternative fasteners or fastening methods will vary depending upon the type of materials from which components 296 and 298 are formed as well as the particular configuration of components 296 and 298.

Components 296 and 298 are preferably manufactured from extruded polyvinylchloride. Other manufacturing techniquest and materials may also be used. Perforations 34, perforations 46 and openings 292 are preferably formed using punching processes. As can be appreciated, the shape and size of perforations 34, perforations 46 and openings 292 may vary. Moreover, the manufacturing techniques used to form perforations 34, perforations 46 and openings 292 may also vary. As a result of this particular construction, component 298 may be easily and inexpensively manufactured. In addition, component 298 may be easily attached and added to existing panel support structures which have been modified to include perforations 34. Although component 298 is illustrated as including spacer 182 and forward flange 286, spacer 182 and forward flange 286 may alternatively be formed as part of component 296 such that spacer 182 and forward flange 286 extend from a lower surface of bottom flange 16.

FIG. 8 is a sectional view illustrating construction accessory 310, a fourth embodiment of construction accessory 10. Construction accessory 310 is identical to construction accessory 210 except that construction accessory 310 additionally includes side flange 312 obliquely extending from lower flange 180 below openings 292. Side flange 312 supports drip leg 184 below and adjacent to casing 190. Side flange 312 is preferably integrally extruded as part of component 298. Alternatively, side flange 312 may be mounted or coupled to lower flange 180 by various fasteners or fastening methods. Side flange 312 covers and protects casing 190. As indicated by arrows 393, 394, and 395, moisture within spacer 74 is effectively discharged away from casing 190.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A construction accessory comprising:

a first flange;

a second flange;

a third flange extending between the first flange and the second flange, wherein the first flange, the second flange and the third flange form a channel and wherein the third flange includes a first plurality of perforations extending through the third flange and offset from one another in a plurality of directions; and a ridge projecting partially between the first flange and the second flange, wherein the ridge is spaced from the third flange.

2. The accessory of claim 1, wherein the first flange, the second flange and the third flange are integrally formed as part of a single unitary body.

3. The accessory of claim 1, including a ridge projecting partially between the first flange and the second flange, wherein the ridge is spaced from the third flange.

4. The accessory of claim 3, including:

a side flange extending non-parallel from the third flange; and a support flange extending non-parallel from the side flange, wherein the support flange forms the ridge.

5. The accessory of claim 1, wherein each of the first plurality of perforations has a maximum diameter of about one-eighth of an inch.

6. The accessory of claim 1, including a fourth flange coupled to and facing the third flange, wherein at least a portion of the fourth flange is spaced from the third flange to form a cavity between the third flange and the fourth flange adjacent the first plurality of perforations.

7. The accessory of claim 6, wherein the fourth flange extends oblique relative to the third flange.

8. A construction system comprising:

a construction accessory including:

a first flange;

a second flange; and a third flange extending between the first flange and the second flange, wherein the first flange, the second flange and the third flange form a channel and wherein the third flange includes a first plurality of perforations extending through the third flange and offset from one another in a plurality of directions; and a construction panel at least partially disposed within the channel between the first flange and the second flange.

9. The system of claim 8, including a coating extending adjacent to the first flange and the construction panel.

10. The system of claim 8, including a second plurality of perforations extending through the first flange.

11. The system of claim 10, wherein the second plurality of perforations are offset from one another in a plurality of directions along the first flange.

12. The system of claim 10, including a coating extending through the second plurality of perforations extending through the first flange.

13. The system of claim 12, wherein the first flange has a first side facing the second flange and a second opposite side, wherein the accessory further includes a shoulder extending adjacent to the second opposite side of the first flange and wherein the coating extends adjacent to the shoulder.

14. The accessory of claim 1, wherein the construction panel has a peripheral edge surface facing the first plurality of perforations extending through the third flange, wherein the edge surface is spaced from the first plurality of perforations.

15. The system of claim 14, including a ridge extending within the channel between the first and second flanges, wherein the ridge engages the panel to space the edge surface of the panel from the first plurality of perforations.

16. The system of claim 15, including:

a side flange extending non-parallel from the third flange; and a support flange extending non-parallel from the side flange, wherein the side flange and the support flange form a channel and wherein the support flange forms the ridge.

17. The system of claim 8, wherein the accessory includes a fourth flange coupled to and facing the third flange, wherein at least a portion of the fourth flange is spaced from the third flange below the first plurality of perforations.

18. The system of claim 8, wherein the first flange, the second flange and the third flange are integrally formed as part of a single unitary body.

19. A construction system comprising;

an accessory including:

a first flange having a first plurality of perforations therethrough;

a second flange;

a third flange extending between the first flange and the second flange, wherein the first flange, the second flange and the third flange form a channel and wherein the third flange includes a second plurality of perforations extending therethrough; and a fourth flange coupled to and facing the third flange wherein at least a portion of the fourth flange is spaced from the third flange to form a cavity between the third flange and the fourth flange adjacent the second plurality of perforations; and a construction panel at least partially disposed within the channel.

20. The system of claim 19, wherein the second plurality of perforations are offset from one another in a plurality of directions.

21. The system of claim 19, wherein the first flange includes an array of perforations extending therethrough.

22. The system of claim 20, including a coating, wherein the coating extends through the first plurality of perforations.

23. The system of claim 22, wherein the first flange has a first side facing the second flange and a second opposite side and wherein the accessory further includes a shoulder extending adjacent the second opposite side, wherein the coating extends adjacent the shoulder.

24. The system of claim 19, wherein the construction panel has a peripheral edge surface and wherein the edge surface is spaced from the second plurality of perforations extending through the third flange.

25. The system of claim 19, wherein at least one of the second plurality of perforations has a maximum diameter of about one-eighth of an inch.

26. The accessory of claim 1, wherein the first flange includes a plurality of perforations extending therethrough.

27. The accessory of claim 6, wherein the fourth flange extends in a plane that does not intersect the third flange.

28. The accessory of claim 6, wherein the fourth flange extends in a plane parallel to the third flange.

29. The system of claim 17, wherein the fourth flange extends in a plane that does not intersect the third flange.

30. The system of claim 19, wherein the fourth flange extends in a plane which does not intersect the third flange.

31. The system of claim 19, wherein the fourth flange extends in a plane parallel to the third flange.

32. The system of claim 19, wherein the second plurality of perforations are offset from one another in a plurality of directions.

33. The system of claim 19, wherein the first plurality of perforations are offset from one another in a plurality of directions.

34. The accessory of claim 1, wherein the first plurality of perforations includes at least three perforations offset from one another in a direction perpendicular to both the first flange and the second flange .

35. The system of claim 8, wherein the first plurality of perforations includes at least three perforations offset from one another in a direction perpendicular to both the first flange and the second flange.

36. The system of claim 19, wherein the second plurality of perforations includes at least three perforations offset from one another in a direction perpendicular to both the first flange and the second flange.

37. A construction system comprising:

a construction accessory including:

a first flange;

a second flange;

a third flange extending between the first flange and the second flange, wherein the first flange, the second flange and the third flange form a channel and wherein the third flange includes a plurality of perforations extending through the third flange; and a fourth imperforate flange facing the third flange and coupled to the third flange, wherein at least a portion of the fourth flange is spaced from the third flange to form a cavity between the third flange and the fourth flange adjacent to the plurality of perforations and wherein the fourth flange extends in a plane that does not intersect the third flange; and a construction panel at least partially disposed within the channel between the first flange and the second flange.

38. The system of claim 37 wherein the fourth flange is directly coupled to the third flange.

39. A construction accessory comprising:

a first flange having a first plurality of perforations therethrough;

a second flange;

a third flange extending between the first flange and the second flange, wherein the first flange, the second flange and the third flange form a channel and wherein the third flange includes a second plurality of perforations extending through the third flange; and a fourth flange coupled to and facing the third flange, wherein at least a portion of the fourth flange is spaced from the third flange to form a cavity between the third flange and the fourth flange adjacent the second plurality of perforations.

* * * * *